US010971826B2

(12) United States Patent
Tsuchiya

(10) Patent No.: US 10,971,826 B2
(45) Date of Patent: Apr. 6, 2021

(54) WIRE WITH TERMINAL

(71) Applicant: Sumitomo Wiring Systems, Ltd., Mie (JP)

(72) Inventor: Takahiro Tsuchiya, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/733,340

(22) Filed: Jan. 3, 2020

(65) Prior Publication Data

US 2020/0227839 A1 Jul. 16, 2020

(30) Foreign Application Priority Data

Jan. 15, 2019 (JP) ..... JP2019-004504

(51) Int. Cl.
*H01R 4/10* (2006.01)
*H01R 4/18* (2006.01)
*H01R 11/12* (2006.01)

(52) U.S. Cl.
CPC ..... *H01R 4/185* (2013.01); *H01R 11/12* (2013.01)

(58) Field of Classification Search
CPC ..... H01R 4/185; H01R 11/12
USPC ..... 439/879, 83
See application file for complete search history.

(56) References Cited

U.S. PATENT DOCUMENTS 5,137,478 A * 8/1992 Graf ..... H01R 4/723 174/84 R
5,245,132 A * 9/1993 Luetzow ..... H01R 4/184 174/126.2
5,316,506 A * 5/1994 Ito ..... H01R 4/188 174/94 R
6,168,470 B1 * 1/2001 Ikeda ..... H01M 2/206 439/620.08
2002/0034898 A1 * 3/2002 Kuwayama ..... H01R 4/188 439/877
2003/0155149 A1 8/2003 Kouji et al.
2005/0095892 A1 * 5/2005 Fukuyama ..... H01R 11/12 439/287
2007/0072455 A1 * 3/2007 Onuma ..... H01R 9/0518 439/98
2007/0270024 A1 * 11/2007 Matsuoka ..... H01R 13/28 439/465

(Continued)

FOREIGN PATENT DOCUMENTS

JP 4335232 9/2009

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A wire with terminal (10) has a terminal (12), and a wire (14) extends rearward from the terminal (12). The terminal (12) includes a fixing portion (18) and a neck (20) extending rearward from the fixing portion (18). A base plate (22) extends rearward from a rear end of the neck (20) and has an insulation barrel (34) crimped to insulation coating (32). A laminated portion (26) has wire barrels (36) connected to a core (30). The laminated portion (26) is laminated on the base plate (22). An easily disassemblable portion (24) couples a rear (22A) of the base plate (22) and a rear (26B) of the laminated portion (26). Guides (28) allow displacement of the laminated portion (26) in a pulling direction D1 of the wire (14) while suppressing displacement of the laminated portion (26) in a lamination direction on the base plate (22).

6 Claims, 11 Drawing Sheets

(56) References Cited

U.S. PATENT DOCUMENTS

| | | | | |
|---|---|---|---|---|
| 2008/0009204 | A1* | 1/2008 | Wei | H01R 4/723<br>439/877 |
| 2008/0032548 | A1* | 2/2008 | Shigehisa | H01R 4/305<br>439/516 |
| 2014/0322954 | A1* | 10/2014 | Lirette, III | F16B 39/02<br>439/359 |
| 2015/0079825 | A1* | 3/2015 | Miyamoto | H01R 4/62<br>439/152 |
| 2015/0111442 | A1* | 4/2015 | Miyamoto | H02G 1/14<br>439/874 |
| 2015/0118905 | A1* | 4/2015 | Mori | H01R 13/52<br>439/606 |
| 2015/0187462 | A1* | 7/2015 | Kondo | H01R 43/16<br>310/71 |
| 2016/0134028 | A1* | 5/2016 | Kondo | H01R 4/183<br>439/877 |
| 2020/0227839 | A1* | 7/2020 | Tsuchiya | H01R 4/185 |

* cited by examiner

WIRE WITH TERMINAL

BACKGROUND

Field of the Invention

This specification relates to a wire with terminal.

Related Art

Japanese Patent No. 4335232 discloses a known example of a wire with terminal. This terminal is easily disassemblable and formed by stamping one conductive metal plate. The terminal includes a fixing portion having a bolt insertion hole in a center, a base plate extending from one side of the fixing portion and a core barrel forming portion for separation projecting from one side the base plate and the fixing portion.

The core barrel forming portion for separation is continuous with the base plate via a bent portion bent at 180° that will become an easily breakable portion. Parts project toward both sides from a base plate overlapping portion that projects from the easily breakable portion. These parts serve as core barrels. Two insulation coating barrels are provided on a rear end of the base plate. If a wire is placed on the upper surfaces of the base plate and the base plate overlapping portion and crimped, the core barrels are crimped to a core of the wire and the insulation coating barrels are crimped to a coating part of the wire.

Generally, in the case of writing off and dismantling an automotive vehicle, components need to be separated and collected. Thus, wires are removed from a vehicle body using a crane. If a wire is pulled up by a large pulling force of the crane, the wire is pulled up with core barrels crimped to a core of the wire. Thus, a pressing piece holding insulation coating barrels and a base plate overlapping portion holding the wire are opened. An easily breakable portion is broken by this pulling force and the wire is separated together with the core barrel forming portion for separation.

A part that couples the base plate and the fixing portion is called a neck. If vibration is applied to the entire terminal, a load of vibration concentrates on the neck. Since the core barrel forming portion for separation is coupled to the neck, vibration is transferred from the neck to the easily breakable portion and the load of vibration is applied to the easily breakable portion. Thus, vibration resistance of the terminal may be reduced.

SUMMARY

A wire with terminal disclosed in this specification has a terminal made of a conductive metal plate and a wire extending rearward from the terminal. The wire includes a core and an insulation coating covering the core. A part of the insulation coating is stripped to expose the core in a front part of the wire. The terminal includes a fixing portion and a neck extending rearward from a rear end of the fixing portion. A base plate extends rearward from a rear end of the neck and has an insulation barrel to be crimped to the insulation coating. A laminated portion is laminated on the base plate and has a core connecting portion to be connected to the core. An easily disassemblable portion is folded and couples a rear part of the base plate and a rear part of the laminated portion. A guide is configured to allow a displacement of the laminated portion in a pulling direction of the wire while suppressing a displacement of the laminated portion in a lamination direction on the base plate when the wire is pulled.

The easily disassemblable portion is broken in separating the wire from the terminal, for example, when a vehicle is dismantled, so that the wire and the laminated portion are separated from the base plate. At this time, the easily disassemblable portion to be broken is located in the rear part of the base plate and spaced rearward from the fixing portion, which is located in front of the base plate. Generally, if vibration is applied with the fixing portion fixed to the vehicle, a load concentrates on the neck of the fixing portion (i.e. front end of the base plate) and also is applied to the easily disassemblable portion. By employing the above configuration, a load of vibration applied to the easily disassemblable portion can be reduced and a reduction in the vibration resistance of the terminal can be suppressed as compared to a configuration in which the easily disassemblable portion is provided near the front end of the base plate, as in the prior art.

The easily disassemblable portion may be connected to each of a rear end on a peripheral edge of the rear part of the base plate and a rear end on a peripheral edge of the rear part of the laminated portion. Additionally, the laminated portion may be folded forward via the easily disassemblable portion. This connection of the easily disassemblable portion to each of the rear edge of the base plate and the rear edge of the laminated portion positions the easily disassemblable portion more rearwardly from the fixing portion as compared to the case where the easily disassemblable portion is connected to either side edges forward of the rear edge in the rear part of the base plate or side edges located forward of the rear edge in the rear part of the laminated portion. Thus, a load of vibration applied to the easily disassemblable portion can be reduced further.

A length between side edges in a width direction intersecting a front-rear direction in the easily disassemblable portion may be shorter than a length between both side edges in the width direction in the base plate and also shorter than a length between both side edges in the width direction in the laminated portion. As a result, the easily disassemblable portion can be broken easily and the wire can be separated easily.

The guides may extend in the lamination direction on the base plate to cover both side edges of the laminated portion with respect to the width direction intersecting the front-rear direction from both side edges with respect to the width direction in a front part of the base plate and may be folded toward a plate surface of the laminated portion. Thus, if the laminated portion is going to be displaced in the lamination direction, the plate surface of the laminated portion contacts the guides to suppress a displacement of the base plate in the lamination direction. Further, the guides cover both side edges of the laminated portion Thus, if the laminated portion is going to be displaced in the width direction, the side edge of the laminated portion contacts the guides to suppress a displacement in the width direction.

According to this specification, it is possible to suppress a load of vibration applied to the easily disassemblable portion and to enhance vibration resistance of the terminal.

DETAILED DESCRIPTION

Figure 1:
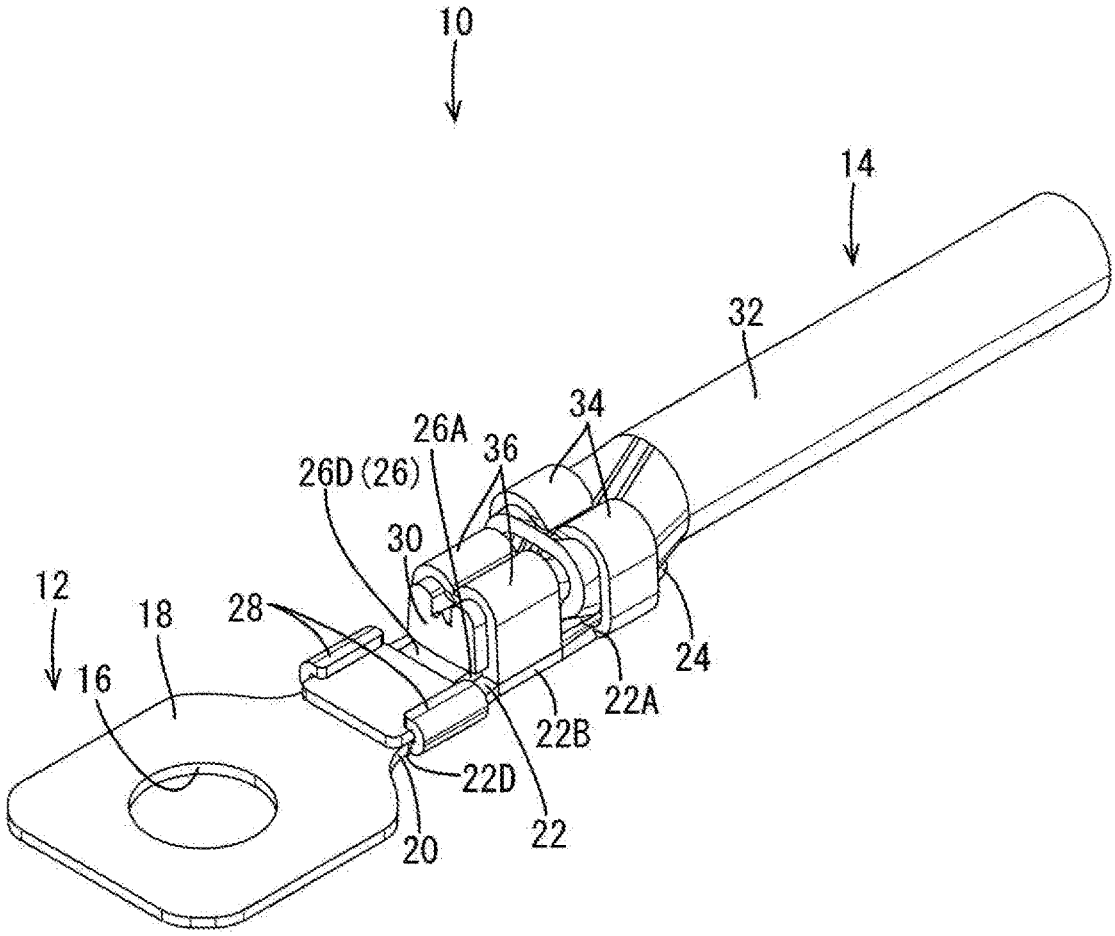
FIG. 1 is a front perspective view of a wire with terminal in an embodiment.
Figure 2:
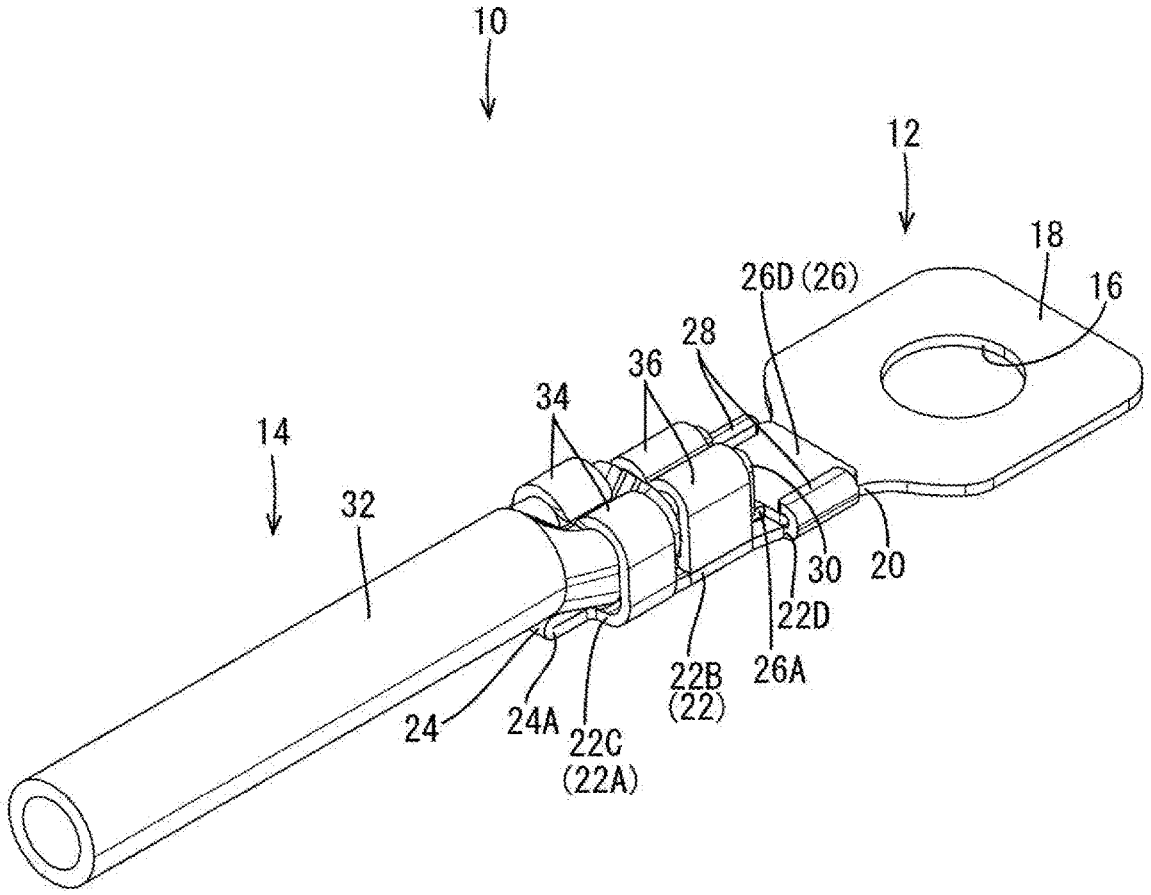
FIG. 2 is a rear perspective view of the wire with terminal.
Figure 3:
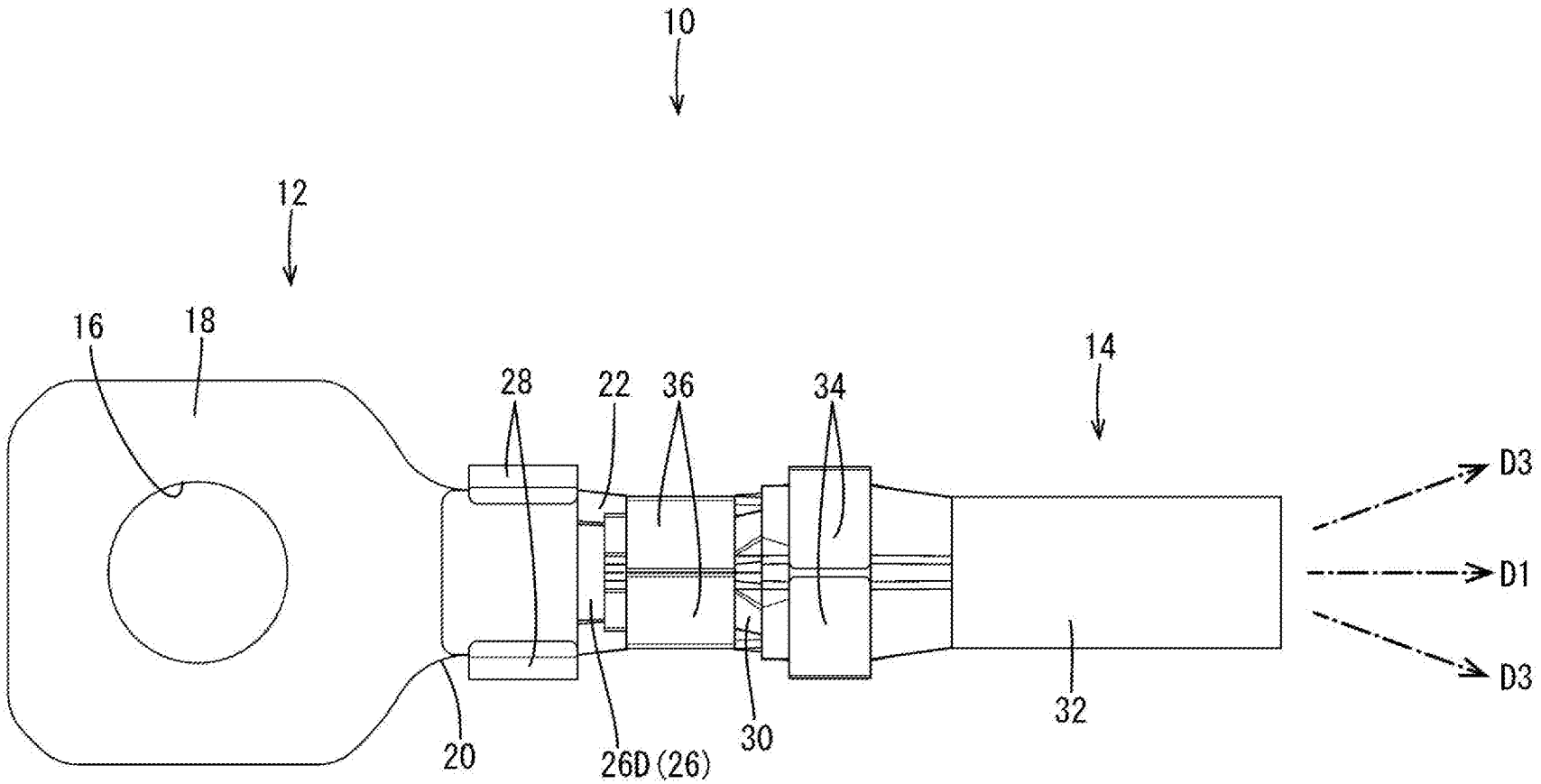
FIG. 3 is a plan view of the wire with terminal.
Figure 4:
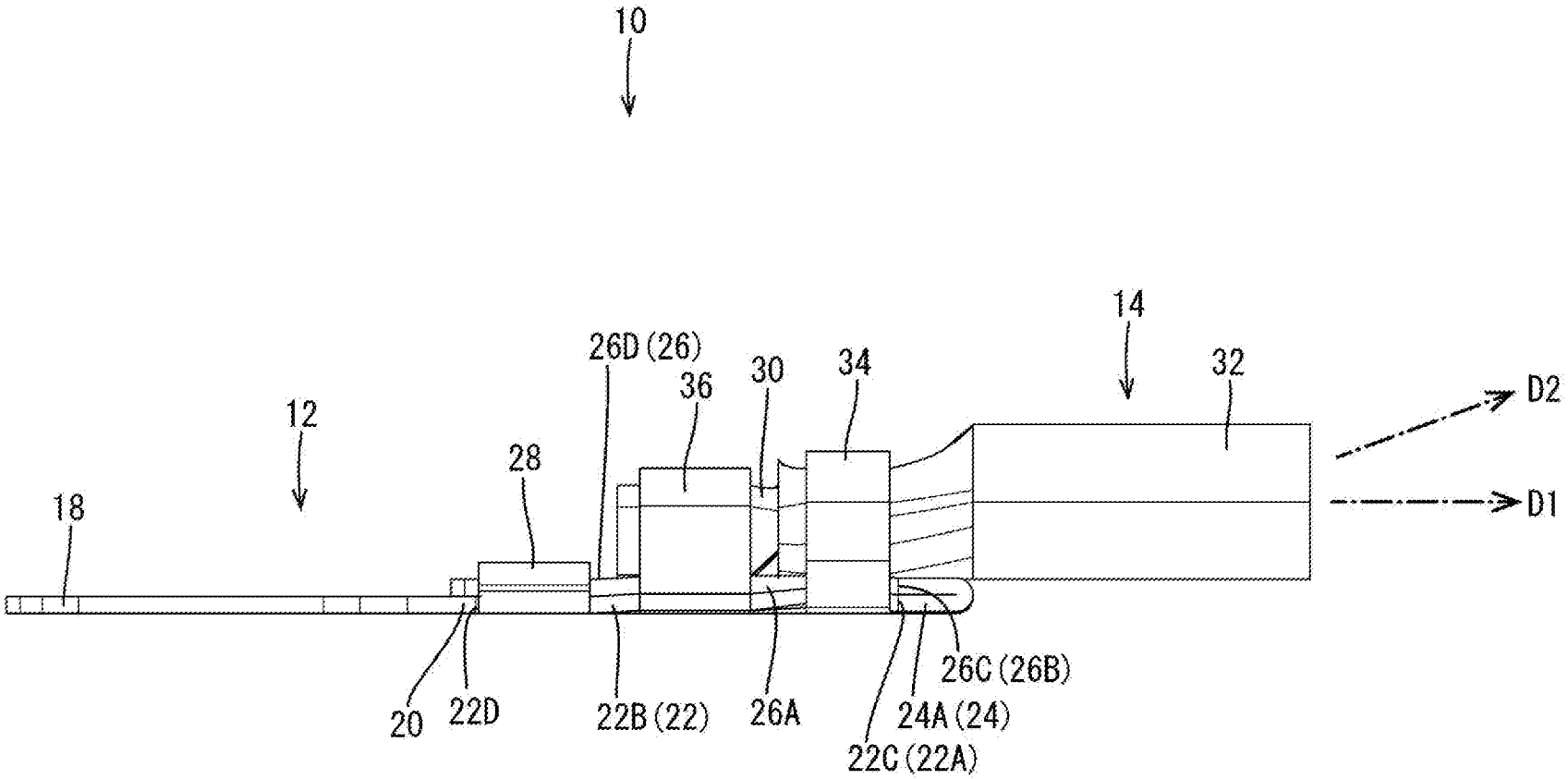
FIG. 4 is a side view of the wire with terminal.

A wire with terminal 10 of an embodiment is described with reference to FIGS. 1 to 9. As shown in FIGS. 1 and 2, the wire with terminal 10 includes a terminal 12 formed by press-working and bending a conductive metal plate and a wire 14 extending rearward from the terminal 12. The terminal 12 is an easily disassemblable terminal capable of easily separating the wire 14 when a vehicle is dismantled. In the following description, a direction from a left side toward a right side in FIG. 3 is defined as a rearward direction (pulling direction D1 of the wire 14) along a front-rear direction, a direction from a lower side toward an upper side in FIG. 3 is defined as a rightward direction along a lateral direction (width direction intersecting the front-rear direction), and a direction from a lower side toward an upper side in FIG. 4 is defined as an upward direction along a vertical direction (lamination direction).

As shown in FIGS. 1 and 2, the terminal 12 includes a fixing portion 18 in the form of a rectangular plate having a fastening hole 16 in a center to receive a bolt (not shown) to be fixed to the vehicle. A neck 20 extends rearward from the rear end of the fixing portion 18, and a base plate 22 extends rearward from the rear end of the neck 20. An easily disassemblable portion 24 extends rearward from a rear end 22C of the base plate 22 and then is folded forward. A laminated portion 26 extends forward from the front end of the easily disassemblable portion 24 and is laminated on the upper surface of the base plate 22. Two guides 28 extend up and then inward from both sides 22B of the base plate 22. The wire 14 includes a core 30 and an insulation coating 32 covering the core 30. A part of the insulation coating 32 is stripped to expose the core 30 at a front part of the wire 14.

As shown in FIGS. 1 and 2, two insulation barrels 34 to be crimped and fixed to the insulation coating 32 of the wire 14 are provided on the sides 22B of the base plate 22, and two wire barrels (core connecting portion) 36 to be crimped and fixed to the core 30 in the front part of the wire 14 are provided on both sides 26A of the laminated portion 26.

As shown in FIGS. 1 and 2, the insulation barrels 34 extend up from both sides 22B of the base plate 22 to cover both side edges 26A of the laminated portion 26, and are crimped to the insulation coating 32 of the wire 14 by folding the tips thereof toward the insulation coating 32.

As shown in FIGS. 1 and 2, the wire barrels 36 extend up from the both side edges 26A of the laminated portion 26 and are crimped to the core 30 of the wire 14 by folding the tips thereof toward the core 30 of the front part 14A of the wire 14. In this way, the terminal 12 and the core 30 are connected electrically.

Figure 5:
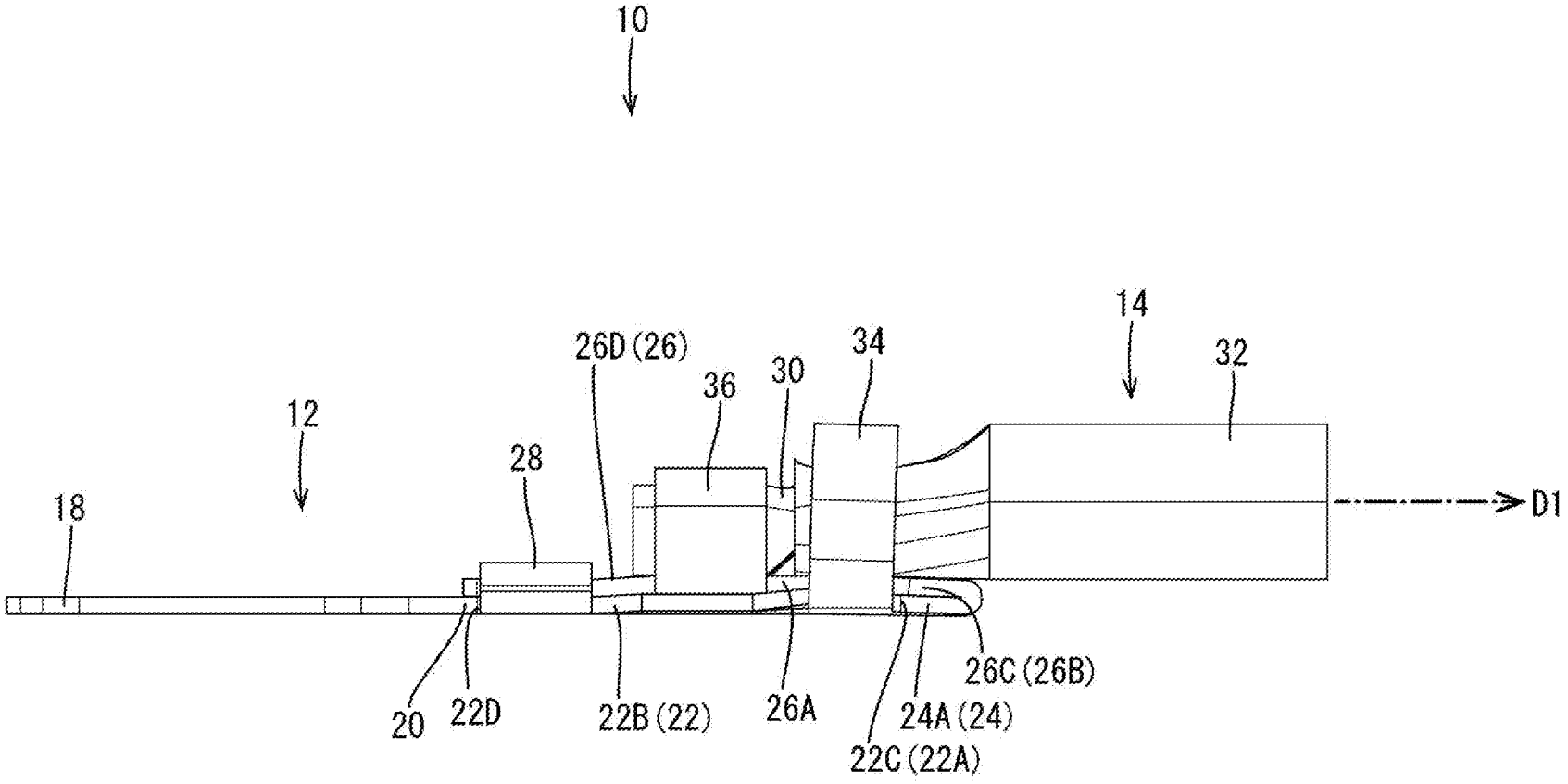
FIG. 5 is a side view of the wire with terminal being disassembled.
Figure 6:
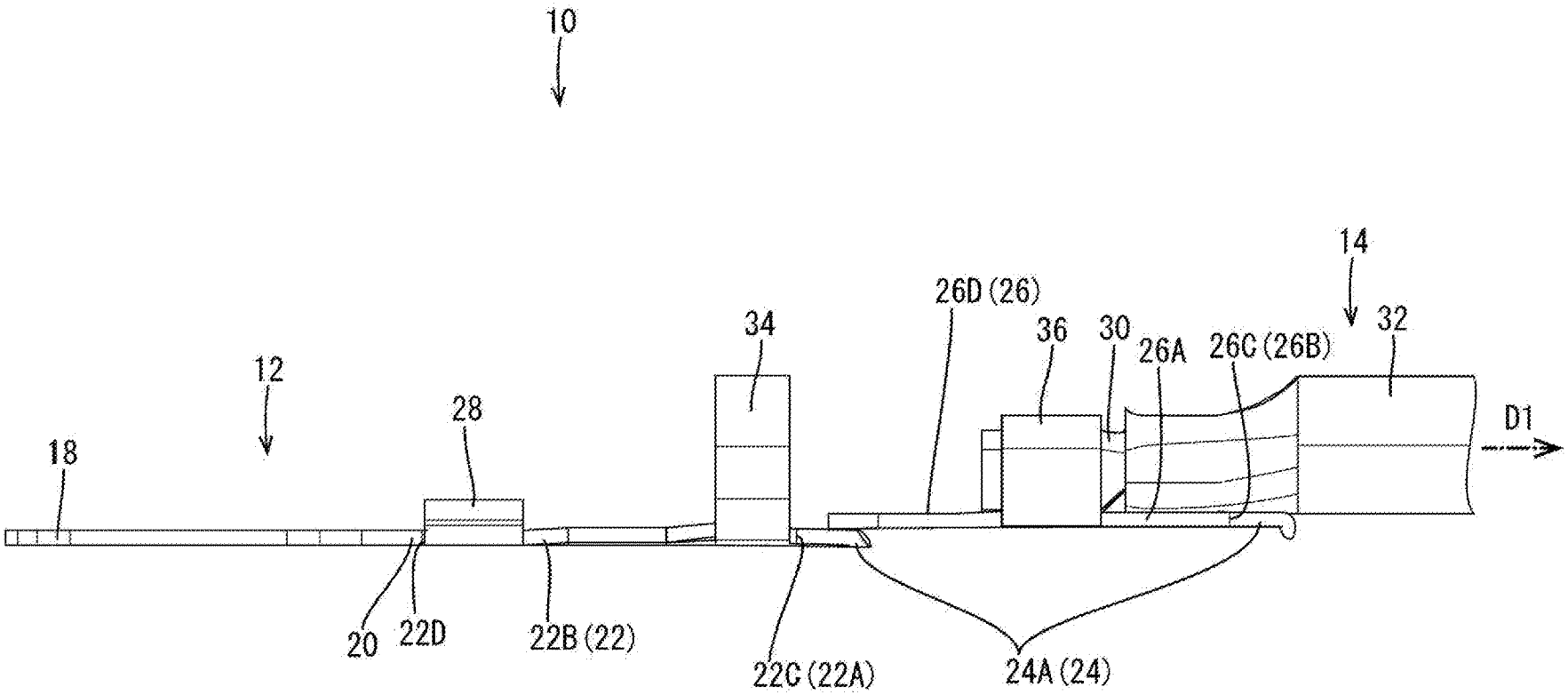
FIG. 6 is a side view of the wire with terminal after disassembling.
Figure 7:
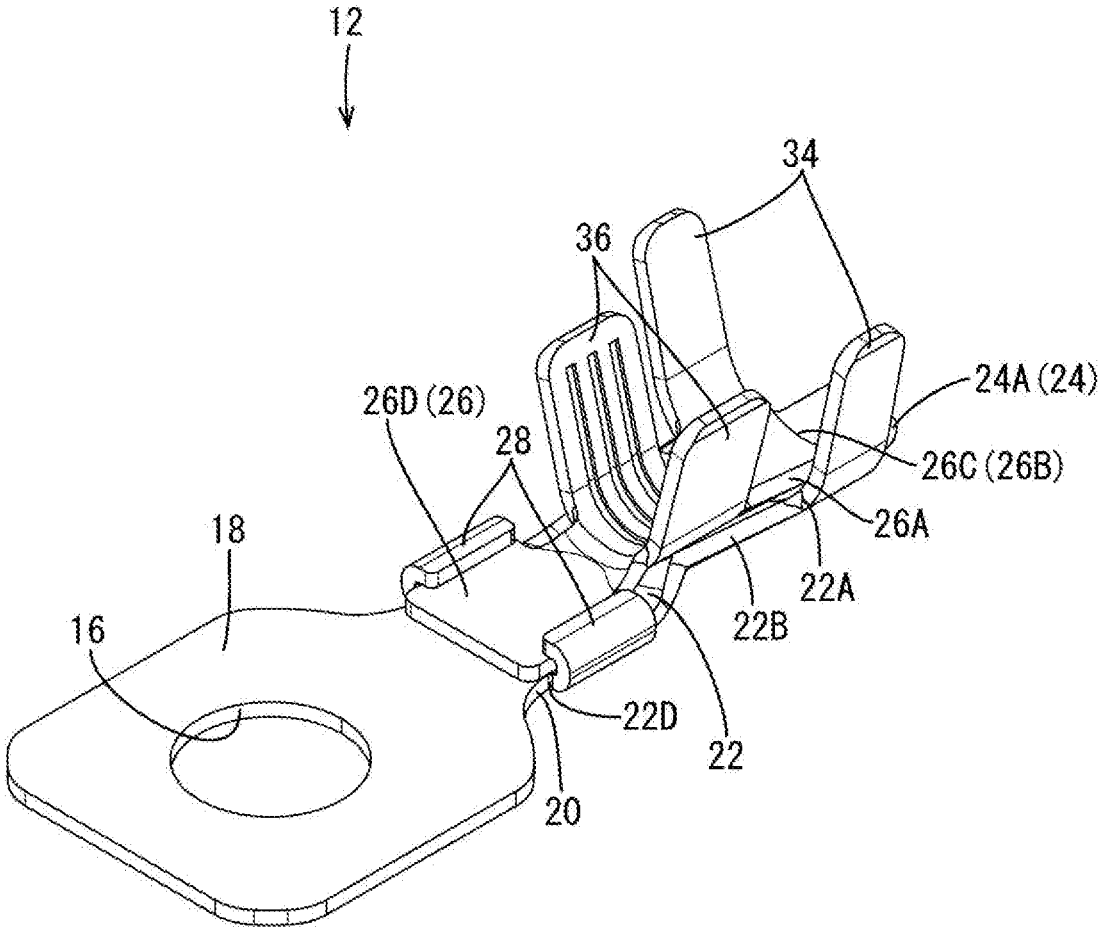
FIG. 7 is a front perspective view of a terminal.
Figure 8:
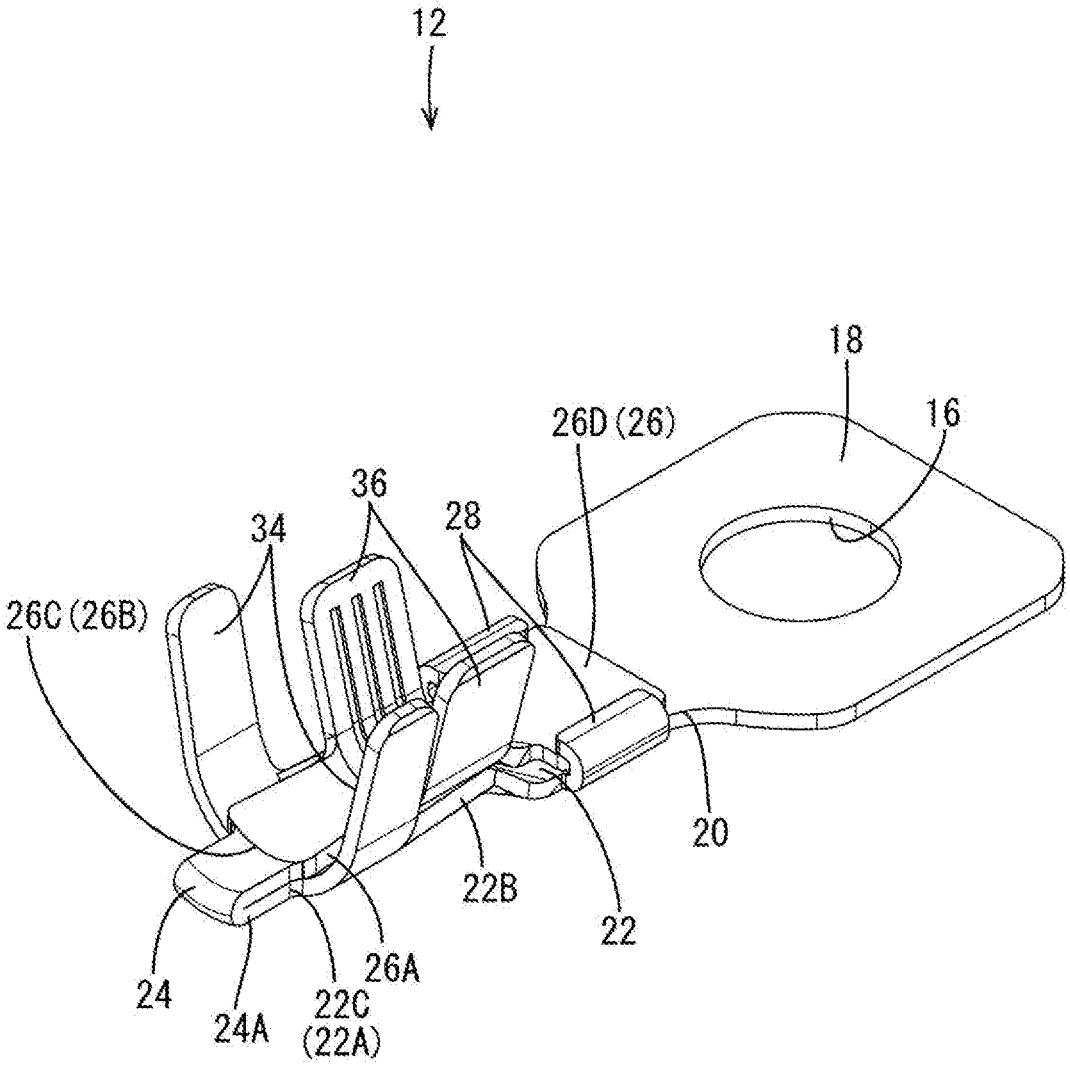
FIG. 8 is a rear perspective view of the terminal.

As shown in FIG. 4, the easily disassemblable portion 24 couples the rear end 22C on the rear part 22A of the base plate 22 and a rear end 26C of a rear part 26B of the laminated portion 26, and is folded from the rear end 22C of the base plate 22 to the rear end 26C of the laminated portion 26. If the wire 14 is pulled rearward in the pulling direction D1 to separate the wire 14 from the terminal 12 when the vehicle is dismantled, the insulation barrels 34 are expanded gradually to release the crimped state to the insulation coating 32 while the laminated portion 26 is slid rearward in the pulling direction D1 with respect to the base plate 22, as shown in FIGS. 4 and 5. If the wire 14 is pulled farther rearward in the pulling direction D1, the easily disassemblable portion 24 is broken, and the wire 14 is separated, together with the laminated portion 26, from the base plate 22, as shown in FIG. 6.

Figure 9:
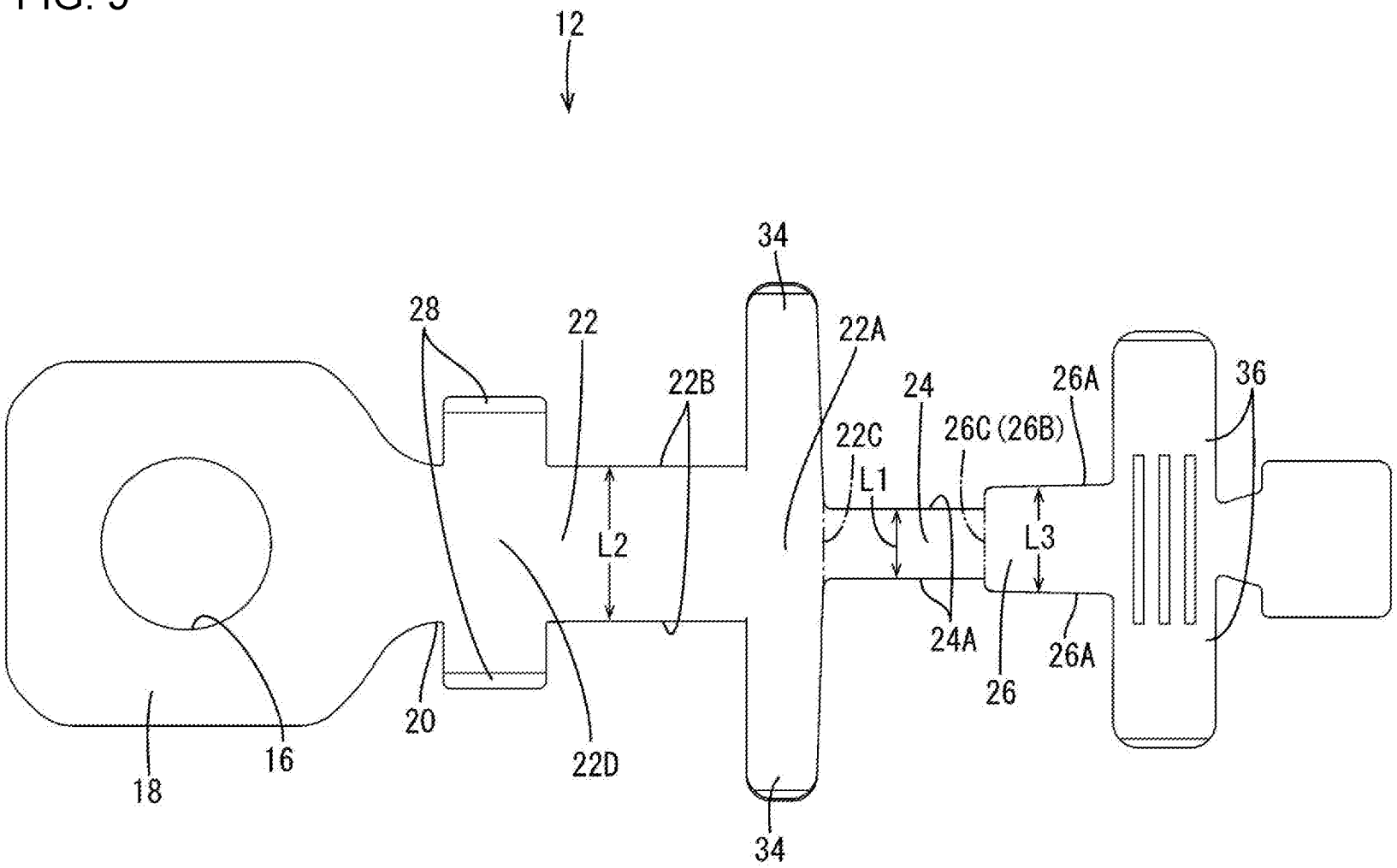
FIG. 9 is a development of the terminal.

In a developed state of the terminal 12 shown in FIG. 9, a length L1 between the both side edges 24A of the easily disassemblable portion 24 is shorter than a length L2 between the side edges 22B of the base plate 22 and a length L3 between the side edges 26A of the laminated portion 26 to make the easily diassemblable portion 24 easily breakable when the vehicle is dismantled. Further, as shown in FIG. 4, the easily diassemblable portion 24 is located in the rear part 22A of the base plate 22 and spaced rearwardly from the fixing portion 18 located in front of the base plate 22.

As shown in FIGS. 1 and 2, the guides 28 extend up to cover both side edges 26A of the laminated portion 26 from the sides 22B in a front part 22D of the base plate 22 and then are bent in along an upper plate surface 26D of the laminated portion 26. If the laminated portion 26 is going to be displaced up, the upper surface 26D of the laminated portion 26 contacts parts of the guides 28 from below to suppress an upward displacement of the laminated portion 26. Further, if the laminated portion 26 is going to be displaced laterally, the side edge 26A of the laminated portion 26 contacts inner surfaces of the guide 28 to suppress lateral displacement of the laminated portion 26. Thus, the guides 28 allow rearward displacement of the laminated portion 26 but suppress upward and lateral displacements since the laminated portion 26 contacts the guide(s) 28 even if the wire 14 is pulled obliquely up and rear in a direction D2 (see FIG. 4) or is pulled obliquely left or right in a direction D3 (see FIG. 3) when the vehicle is dismantled.

Next, functions of this embodiment are described.

If an engine of the vehicle operates with the fixing portion 18 of the wire with terminal 10 bolted to the vehicle, engine vibration is transferred to the fixing portion 18, and a load of vibration concentrates on the neck 20 of the fixing portion 18. The easily disassemblable portion 24 is in the rear part 22A of the base plate 22 and is spaced rearward from the neck 20. Thus, the load of vibration applied to the easily disassemblable portion 24 can be reduced as compared to a configuration in which the easily disassemblable portion 24 is in a front part of the base plate 22, as before. In this way, a reduction in the vibration resistance of the terminal 12 is suppressed.

The easily disassemblable portion 24 is connected to each of the rear end 22C of the rear part 22A of the base plate 22 and the rear end 26C of the rear part 26B of the laminated portion 26. Thus, the easily disassemblable portion 24 is more rearward from the fixing portion 18, as compared to the case where the easily disassemblable portion 24 is connected to the peripheral sides 22B of the rear part 22A of the base plate 22 and the peripheral sides 26A of the rear part 26B of the laminated portion 26. Thus, the load of vibration applied to the easily disassemblable portion 24 is reduced further.

As described above, the easily disassemblable portion 24 is broken in separating the wire 14 from the terminal 12, for example, when the vehicle is dismantled so that the wire 14 is separated, together with the laminated portion 26, from the base plate 22. At this time, the easily disassemblable portion 24 to be broken is at the rear part 22A of the base plate 22 and rearward from the fixing portion 18 located in front of the base plate 22. If vibration is applied with the fixing portion 18 fixed to the vehicle, a load generally concentrates on the neck 20 of the fixing portion (i.e. front end of the base plate 22) and also is applied to the easily disassemblable portion 24. With the above configuration, a load of vibration applied to the easily disassemblable portion 24 can be reduced, and a reduction in the vibration resistance of the terminal 12 can be suppressed, as compared to a configuration in which an easily disassemblable portion is near the front end of a base plate, as before.

The easily disassemblable portion 24 is connected to the rear end in the rear part 22A of the base plate 22 and the rear end 26C of the rear part 26B of the laminated portion 26. Thus, the laminated portion 26 is folded forward via the easily disassemblable portion 24.

The easily disassemblable portion 24 is connected to each of the rear end 22C of the base plate 22 and the rear end 26C of the laminated portion 26, and therefore is spaced more rearwardly from the fixing portion 18 than in the case where an easily disassemblable portion is connected to at least either sides located forward of a rear end in a rear part of a base plate or sides located forward of a rear end in a rear part of a laminated portion. Thus, a load of vibration applied to the easily disassemblable portion 24 is reduced further.

Further, the length between the side edges 24A in the width direction intersecting the front-rear direction in the easily disassemblable portion 24 may be shorter than the length between the side edges 22B in the width direction in the base plate 22 and shorter than the length between the side edges 26A in the width direction in the laminated portion 26.

The length between the side edges 24A in the lateral direction (width direction) of the easily disassemblable portion 24 is shorter than the length between the side edges 22B of the base plate 22 and the length between the side edges 26A of the laminated portion 26. Thus, the easily disassemblable portion 24 can be broken more easily and the wire 14 can be separated more easily.

Further, the guides 28 may extend in the lamination direction on the base plate to cover the side edges 26A of the laminated portion 26 with respect to the width direction intersecting the front-rear direction from the side edges 22B with respect to the width direction in the front part 22D of the base plate 22 and then may be folded toward the upper surface (plate surface) 26D of the laminated portion 26.

The guides 28 extend up (lamination direction) to cover both side edges 26A of the laminated portion 26 from the both side edges 22B of the front part 22D of the base plate portion 22 and are folded toward the upper surface (plate surface) 26D of the laminated portion 26. Thus, if the laminated portion 26 is going to be displaced up (lamination direction), the upper surface (plate surface) 26D of the laminated portion 26 contacts the guides 28 to suppress an upward displacement of the base plate 22. Further, the guides 28 cover both side edges 26A of the laminated portion 26, if the laminated portion 26 is going to be displaced laterally in the width direction, the side edge 26A of the laminated portion 26 contact the guide 28 to suppress lateral displacement of the laminated portion 26.

The invention is not limited to the above described and illustrated embodiment. For example, the following various modes also are included.

Figure 10:
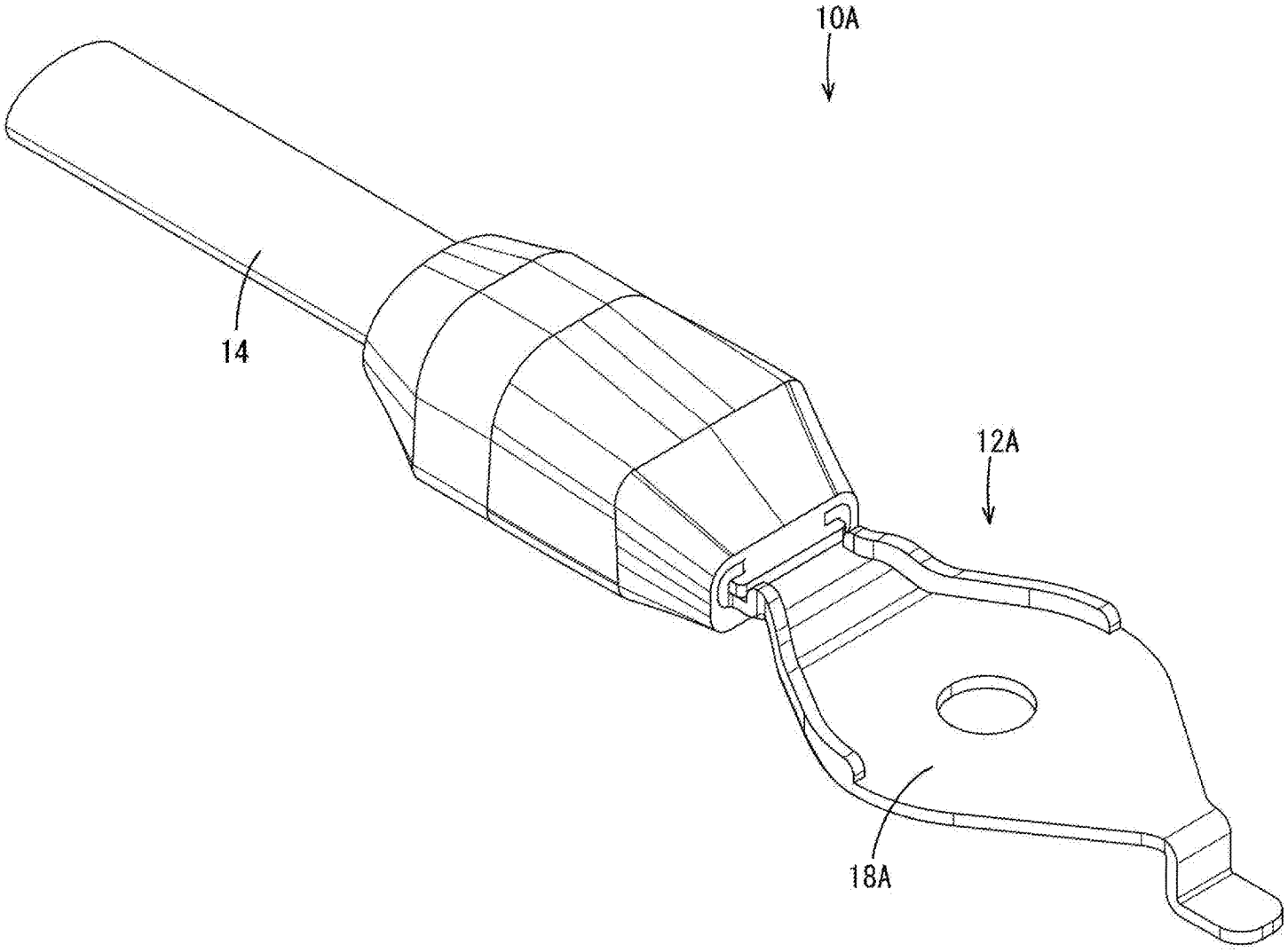
FIG. 10 is a front perspective view of a wire with terminal in other embodiments.
Figure 11:
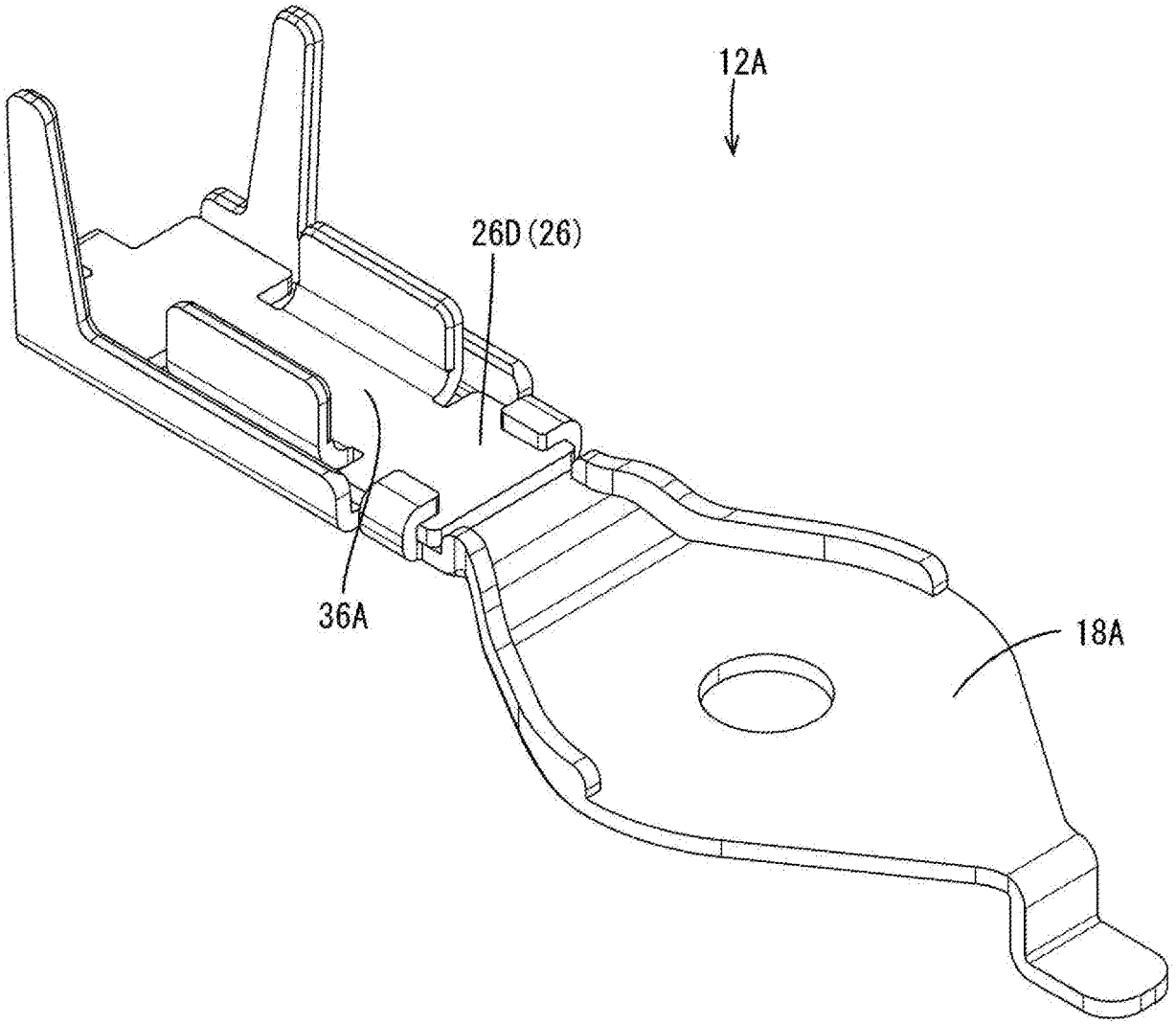
FIG. 11 is a front perspective view of a terminal in the other embodiments.

Although the core connecting portion is constituted by the wire barrels 36 to be crimped and connected to the core 30 in the above embodiment, the core connecting portion may be constituted by a welded portion 36A provided on an upper surface 26D of a laminated portion 26 as in a wire with terminal 10A shown in FIGS. 10 and 11 and a terminal 12A in the wire with terminal 10A and a core of a wire 14 may be connected to the welding portion 36A by welding. Further, a method for welding the core of the wire 14 to the welding portion 36A is not limited. For example, the core may be connected to the welding portion 36A by ultrasonic welding or resistance welding.

Although the fixing portion 18 is in the form of a rectangular plate in the above embodiment, the shape of the fixing portion 18 is not limited. For example, a fixing portion 18A may have a rhombus shape as shown in FIGS. 10 and 11.

Although the easily disassemblable portion 24 is connected to each of the rear end 22C of the rear part 22A of the base plate 22 and the rear end 26C of the rear part 26B of the laminated portion 26, an easily disassemblable portion may be connected to sides on a rear part of a base plate and sides on a rear part of a laminated portion.

LIST OF REFERENCE SIGNS

10, 10A: wire with terminal
12: terminal
14: wire
18, 18A: fixing portion
20: neck
22: base plate
22A: rear part
22B: side edge
22C: rear end
22D: front part
24: easily disassemblable portion
24A: side edge
26: laminated portion
26A: side edge
26B: rear part
26C: rear end
26D: upper surface (plate surface)
28: guide
30: core
32: insulation coating
34: insulation barrel
36: wire barrel (core connecting portion)
36A: welding portion (core connecting portion)
L1, L2, L3: length
D1: pulling direction

What is claimed is:

1. A wire with terminal with a terminal made of a conductive metal plate and a wire extending rearward from the terminal, wherein:

the wire includes a core and an insulation coating covering the core and a part of the insulation coating is stripped to expose the core in a front part of the wire, and the terminal includes:

a fixing portion;

a neck extending rearward from a rear end of the fixing portion;

a base plate having an insulation barrel to be crimped to the insulation coating, the base plate extending rearward from a rear end of the neck;

a laminated portion having a core connecting portion to be connected to the core;

an easily disassemblable portion coupled to a rear part of the base plate and a rear part of the laminated portion, the easily disassemblable portion folded forward so that the laminated portion is in surface-to-surface contact with an upper surface of the base plate and is laminated thereto with the core connecting portion forward of the insulation barrel; and guides configured to allow a displacement of the laminated portion in a pulling direction of the wire while suppressing a displacement of the laminated portion in a lamination direction on the base plate when the wire is pulled.

2. The wire with terminal of claim 1, wherein:

the easily disassemblable portion is connected to each of a rear end of the base plate and a rear end of the laminated portion, and the laminated portion is folded forward via the easily disassemblable portion.

3. The wire with terminal of claim 2, wherein a length between side edges in a width direction intersecting a front-rear direction in the easily disassemblable portion is shorter than a length between both side edges in the width direction in the base plate and a length between both side edges in the width direction in the laminated portion.

4. The wire with terminal of claim 3, wherein the guides extend in the lamination direction on the base plate to cover both side edges of the laminated portion with respect to a width direction intersecting a front-rear direction from both side edges with respect to the width direction in a front part of the base plate and are folded toward a plate surface of the laminated portion.

5. The wire with terminal of claim 1, wherein a length between side edges in a width direction intersecting a front-rear direction in the easily disassemblable portion is shorter than a length between both side edges in the width direction in the base plate and a length between both side edges in the width direction in the laminated portion.

6. The wire with terminal of claim 1, wherein the guides extend in the lamination direction on the base plate to cover both side edges of the laminated portion with respect to a width direction intersecting a front-rear direction from both side edges with respect to the width direction in a front part of the base plate and are folded toward a plate surface of the laminated portion.

* * * * *